US006877335B2

(12) United States Patent
Triboix

(10) Patent No.: US 6,877,335 B2
(45) Date of Patent: Apr. 12, 2005

(54) AIR CONDITIONING DEVICE

(75) Inventor: Alain Triboix, Fouchy (FR)

(73) Assignee: Extenzo A.F.C., Griesheim-sur-Souffel (FR)

( * ) Notice: Subject to any disclaimer, the term of this patent is extended or adjusted under 35 U.S.C. 154(b) by 48 days.

(21) Appl. No.: 10/398,584

(22) PCT Filed: Oct. 8, 2001

(86) PCT No.: PCT/FR01/03094

§ 371 (c)(1),
(2), (4) Date: Apr. 8, 2003

(87) PCT Pub. No.: WO02/31414

PCT Pub. Date: Apr. 18, 2002

(65) Prior Publication Data

US 2004/0020235 A1 Feb. 5, 2004

(30) Foreign Application Priority Data

Oct. 9, 2000 (EP) ..... 00/12898

(51) Int. Cl.[7] ..... F25D 17/04
(52) U.S. Cl. ..... 62/418; 62/407; 62/447
(58) Field of Search ..... 62/418, 407, 408, 62/447, 329, 186; 454/296

(56) References Cited

U.S. PATENT DOCUMENTS

| | | | | |
|---|---|---|---|---|
| 2,781,557 A | | 2/1957 | Ericson | |
| 3,352,076 A | | 11/1967 | Jones | |
| 3,779,150 A | | 12/1973 | Sproul, Sr. | |
| 3,919,457 A | * | 11/1975 | Steiner | 174/48 |
| 4,408,433 A | | 10/1983 | Scherrer | |
| 4,887,437 A | * | 12/1989 | Fenton et al. | 62/186 |
| 5,261,857 A | | 11/1993 | Petterson et al. | |
| 6,606,875 B1 | * | 8/2003 | Grand et al. | 62/239 |

FOREIGN PATENT DOCUMENTS

| | | |
|---|---|---|
| DE | 7303776 | 5/1973 |
| DE | 89 08 672 | 11/1989 |
| EP | 0 457 289 | 11/1991 |
| EP | 0 552 690 | 7/1993 |

* cited by examiner

*Primary Examiner*—Melvin Jones
(74) *Attorney, Agent, or Firm*—Young & Thompson

(57) ABSTRACT

An air conditioning device using a false ceiling (2) and ensuring air diffusion along walls by providing intake of treated air into a volume created by the gap between the ceiling (1), the sealed false ceiling (2) and the walls (3), comprising spacers (4) between the wall and the section (6) fixing on edge the false ceiling, of slight width parallel to the wall and uniformly spaced, the spacers, fixed on the wall or on the section fixing on edge the false ceiling, providing a gap between the wall and the false ceiling, so as to enable air diffusion over the entire periphery of the premises. The device is provided with one or several beads (7) clipped between the section and the wall so as to close the gap in the zones where air diffusion should be blocked.

31 Claims, 7 Drawing Sheets

AIR CONDITIONING DEVICE

BACKGROUND OF THE INVENTION

This invention relates to a building air-conditioning device that uses treated air that is admitted in a volume that is created between walls, a ceiling and a sealed false ceiling, but that comprises a thin space that is reserved over all or part of its periphery. This treated air, after having cooled or heated the false ceiling, which in its turn radiates to the building, diffuses in the space between the wall and the false ceiling to ensure the remainder of the heating or cooling of the building, as well as the mixing and the renewal of the air of the building.

DESCRIPTION OF THE RELATED ART

Air-conditioning processes by the ceiling that are divided essentially into three categories are known:

So-called static processes, which in all cases require a renewal of the air by an independent ventilation system, and which in heating mode ensure the increase in temperature of the false ceiling by electric heating films or hot water circulation, whereby this false ceiling then ensures the heating of the building by radiation, which exhibits the drawback of an often excessive false ceiling temperature that interferes with thermal comfort. These same processes, in cooling mode, use circulating water, for example in coils, to cool the false ceiling (EP-A-0 552 690), which in its turn radiates to the building, which exhibits the drawback of limiting the temperature of the false ceiling so as to prevent condensation problems and therefore to limit the cooling possibilities of such a system. Finally, these systems generally operate only in one of two modes, namely heating or cooling;

The processes by a blowing mixture of hot or cold air (U.S. Pat. No. 3,779,150) via nozzles, slots or linear diffusers that are placed in the false ceiling that require a considerable speed of introduction of the treated air into the occupied volume. These processes bring about a thermal discomfort of the occupants because of the air stream sensations and because the air is not distributed uniformly in the building.

A process that uses a diffusion of air over all of a permeable false ceiling that has, both in heating mode and in cooling mode, good performance levels in terms of comfort, but that exhibit the drawback of resulting in a quick fouling of the permeable ceiling.

Also known by DE-U-89 08 672 is a false ceiling attachment that makes possible the creation of a peripheral space for air passage for an air-conditioning installation, whereby this attachment is carried out, at regular intervals, by crosspieces. Such an embodiment does not make it possible, however, to influence specifically the diffusion of air along preferred paths.

Furthermore, U.S. Pat. No. 3,352,076 describes a false ceiling section that is equipped with sealable openings that are placed at regular intervals over its length and that can be closed or open based on requirements. However, this document does not describe a means that makes possible a flexible and careful control of a flow of air into determined locations along the walls.

SUMMARY OF THE INVENTION

This invention has as its object to remedy these drawbacks by proposing an air-conditioning device that makes it possible to improve the diffusion of air in the building along the walls, while perfectly controlling its distribution. Below, air conditioning is defined as the creation of an artificial climate in the proper building to establish excellent conditions of comfort for the occupants.

For this purpose, the air-conditioning device that uses a false ceiling and that ensures a diffusion of air along the walls by allowing treated air to enter in a volume created by the space between the ceiling, the sealed false ceiling and the walls, which includes crosspieces between the wall and the edge rail of the false ceiling, of a small width parallel to the wall and evenly spaced, whereby said crosspieces, attached to the wall or to the edge rail of the false ceiling, reserve a space between the wall and the false ceiling so as to allow the diffusion of air over the entire periphery of the building, is characterized in that it is equipped, in predetermined zones, with one or several rods that are gripped between the rail and the wall so as to close the space in the zones where it is desired to block the diffusion of the air.

The device according to the invention allows the air conditioning of a building by using a false ceiling and by ensuring a diffusion of air along the walls. It allows treated air to enter in a volume that is created by the space between the ceiling, the sealed false ceiling and the walls. The treated air can be new air or recycled air or a mixture of the two: it can be filtered, set at a desired degree of humidity, cooled or heated. This treated air is introduced in the volume above the false ceiling by any suitable means such as one or more intake openings made in the wall between the ceiling and the false ceiling. This treated air can also be produced by a fan-convector unit or a ceiling light box that is placed directly in the volume above the false ceiling if the space between the false ceiling and the ceiling is adequate.

The device according to the invention comprises for this purpose crosspieces between the wall and the edge rail of the false ceiling, of a small width parallel to the wall and evenly spaced. The false ceiling can be made of a rigid material or consists of a sealed elastic membrane stretched between the edge rails. Said crosspieces reserve a space between the wall and the false ceiling and thus make possible the diffusion of the air over the entire periphery of the building. These crosspieces are bolted, for example, to the walls or to the edge rail of the false ceiling and have a thickness perpendicular to the wall that is calculated to obtain a determined diffusion rate of the treated air in the building. The crosspieces can also be made in the mass of the edge rail if the latter is produced, for example, of plastic material in a single injection-molding operation. The treated air, when it expands at very low speed into the volume above the false ceiling, heats or cools the ceiling and the false ceiling that radiates in turn to the building. The air then diffuses along the walls outside of the occupied zone of the building at a temperature that is moderate and that ensures the remainder of heating or cooling, the mixing of the air of the building and, optionally, the renewal of air. Considerable comfort results from the device according to the invention because:

The heat load of the building is ensured in part by radiation and in part by circulation of air in the building, The difference in temperature between the different walls and the air is thus reduced, The air is diffused beyond the occupied zone of the building, The air is diffused uniformly in the entire building.

According to a characteristic of the invention, the rods that are gripped between the rail and the wall can be full rods. It is also possible to produce these rods in the form of rods pierced with orifices such as holes or slots. Thus, it is possible to prevent the diffusion of the air, for example in the vicinity of the recovery of the recycled air or the extraction of fouled air, which would bring about direct recovery of the air without it circulating in the building.

According to a particular embodiment, so as to reduce the losses of load of the air circulating in the space created between the ceiling and the false ceiling, the edge rail of the false ceiling comprises in its upper part a rounded shape on its upper ridge on the side of the wall, whereby the center of the curvature of this rounded shape is oriented toward the interior of the building.

In cooling mode, the air easily penetrates the building even if its speed in the space reserved between the wall and the false ceiling is low because it is heavier than the ambient air. In contrast, in heating mode, it is necessary to increase this diffusion speed so as to force this air to penetrate the building and to avoid the stratification phenomenon. For this purpose, according to a particular embodiment, a rod, whose thickness perpendicular to the wall is less than the distance between the wall and the wall-side face of the core of the edge rail, is gripped, for example, by the bottom, in the space between the edge rail and the wall over the entire periphery or over a portion of the periphery of the building. Narrow flexible blades that extend parallel to the wall and that are evenly spaced on the rod can allow, by a spring effect, the gripping of said rod.

The above-described solution exhibits the drawback of requiring the placement and then the removal of said rod according to heating or cooling requirements. All of the particular embodiments described below aim at eliminating this drawback by controlling the extent of closing of the space reserved between the wall and the edge rail, for example at a predetermined temperature at a certain level and in a certain location in a building.

For this purpose, the edge rail is provided with a means that allows a variable closing of the space reserved between the wall and the edge rail.

According to a particular embodiment, the means that makes possible a variable closing of the space reserved between the wall and the edge rail comprises, on the one hand, a horizontal wing that is integral with the edge rail on its upper part, and, on the other hand, a section called a closing strip that consists of a blade, parallel to the upper wing of the edge rail and above, extended from the wall side by a rounded shape, whose center of the curvature is oriented toward the interior of the building, whereby the end of the rounded shape on the side of the wall will just penetrate the space reserved between the wall and the edge rail above the crosspieces by resting on the upper ridge on the side of the wall of the edge rail, whereby said closing profile has, in addition, an L shape that produces a closed box between the curved part and the blade, whereby said closing strip is linked to the upper wing of the edge rail via a vertical blade that is located closer to the building-side end than the upper ridge on the side of the wall of the edge rail, whereby this joint between said closing strip and the vertical blade is carried out by a zone of less thickness in its upper portion or by any other means. Also provided is a means that makes it possible to actuate the rotation of the closing strip around the joint. In addition, blocks with less thickness perpendicular to the wall than the crosspieces, but with a width parallel to the wall that is essentially identical or equal to that of said crosspieces, can be placed flush with the wall so as to limit the closing of the space.

According to another particular embodiment, coil springs or leaf springs, called retractile springs below, are placed at regular intervals, between the blade of the closing strip and the horizontal upper blade of the edge rail beside its building-side end, keeping the closing strip abutting against the upper wall-side stop of the edge rail.

According to a particular embodiment, the means that makes it possible to actuate the rotation of the closing strip around the joint consists of evenly spaced electromagnets, mounted, thanks to a recess made in the edge rail between the blade of the closing strip and the upper horizontal wing of the edge rail, close to the vertical blade that makes the connection between the edge rail and the closing strip but from the side of the wall. Said electromagnets are controlled at a distance either by a circuit breaker or by slaving to a temperature sensor that is placed in the volume created by the space between the ceiling and the sealed false ceiling and the walls. The action of said electromagnets causes the rotation of the closing strip around the joint when the building needs to be heated instead of cooled. If necessary, the return of the closing strip into its position that abuts against the blocks is carried out by the action of the retractile springs.

According to a particular embodiment, the means that makes it possible to actuate the rotation of the closing strip around the joint consists of reservoirs that contain wax, liquid or saturating vapor, so-called expansion bulbs of wax or liquid or saturating vapor, evenly spaced and mounted thanks to a recess made in the edge rail between the blade of the closing strip and the horizontal wing of the edge rail close to the vertical blade that makes the connection between the edge rail and the closing strip and the side of the wall. In their upper part, said bulbs comprise a piston or an elastic membrane or a bellows that actuates the rotation of the closing strip around the joint in case of an increase in temperature, causing the expansion of the wax or of the liquid or the evaporation of a fluid that is located in said bulbs.

According to a particular embodiment, the means that makes it possible to actuate the rotation of the closing strip around the joint consists of U-shaped bimetallic strips that comprise two long horizontal wings that consist of two materials with very different expansion coefficients that are integral with one another over their entire surface. Said bimetallic strips are gripped at regular intervals in slots that are provided for this purpose in the blade of the closing strip at the building-side end and in the upper horizontal wing of the edge rail at the building-side end, whereby said bimetallic strips are made such that of the two materials of which they consist, the one that has the higher expansion coefficient under the effect of a temperature increase is located on the outside face of the U that constitutes the bimetallic strip. Thus, in the case of an increase in temperature of the air that is located above the false ceiling, a proximity of the two ends of the bimetallic strips causes the lifting of the closing strip by rotation around the joint that is provided in the top of the vertical blade ensuring the connection between the edge rail and the closing strip.

According to a particular embodiment, the means that allows a variable closing of the space reserved between the wall and the edge rail comprises a corrugated section that ends on the side of the wall by a rounded shape, whose end penetrates the space reserved between the wall and the edge rail and is attached by its other end to the building-side end of the upper horizontal wing of the edge rail, whereby said corrugated section is, on its upper face, covered by and integral with a sheet that consists of a material that has a lower thermal expansion coefficient than the one of the material that constitutes the corrugated section. Under the effect of a differential expansion of the two materials that constitute the corrugated section, there results, during an increase in temperature in the volume above the false ceiling, a more or less significant closing of the space reserved between the wall and the rail, a closing optionally limited by the blocks that are located above the crosspieces.

BRIEF DESCRIPTION OF THE DRAWINGS

The accompanying drawings illustrate the invention.

DESCRIPTION OF THE PREFERRED EMBODIMENTS

Figure 1:
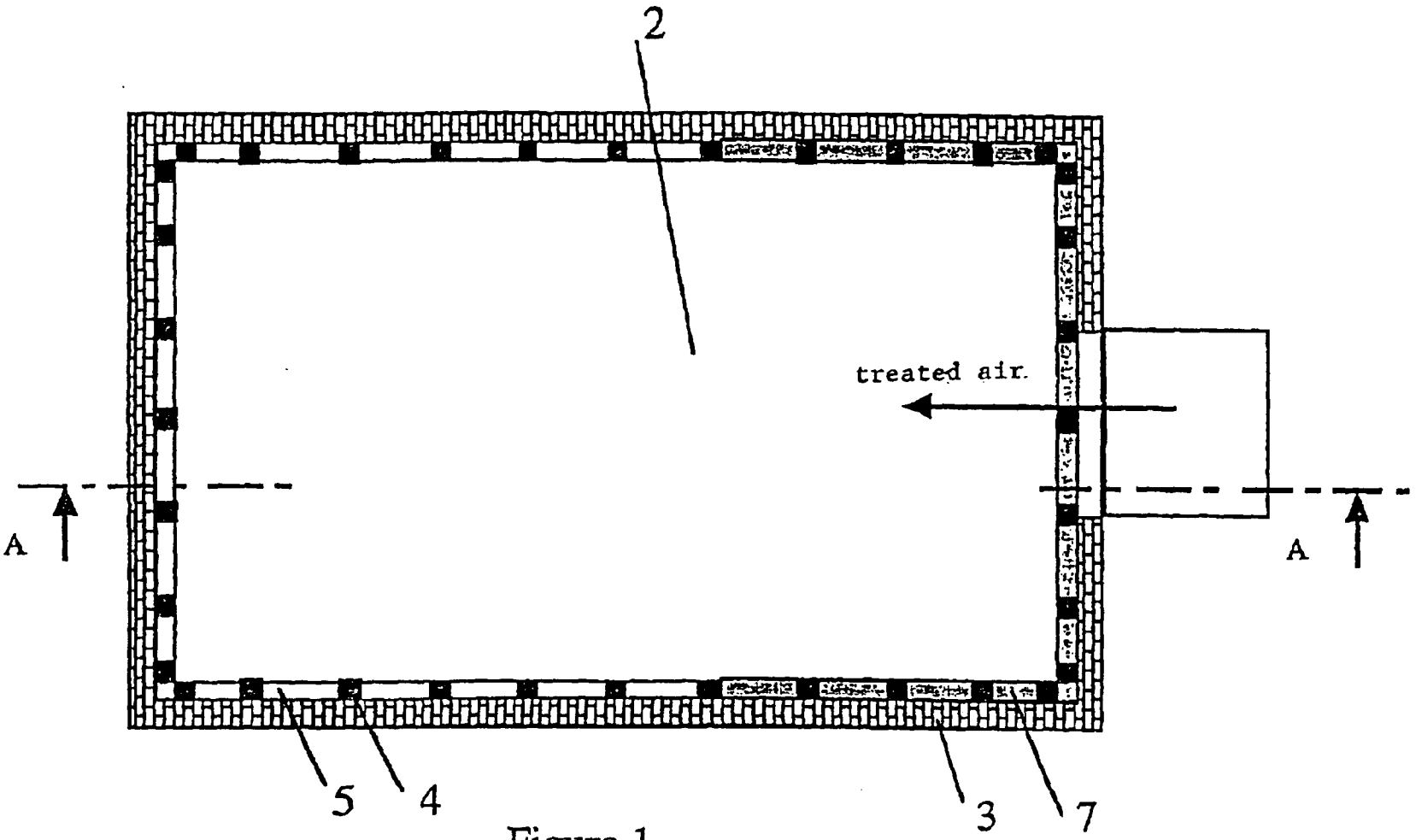
FIG. 1 shows a top view of a cutaway in a horizontal plane of an air-conditioned building according to the invention.
Figure 2:
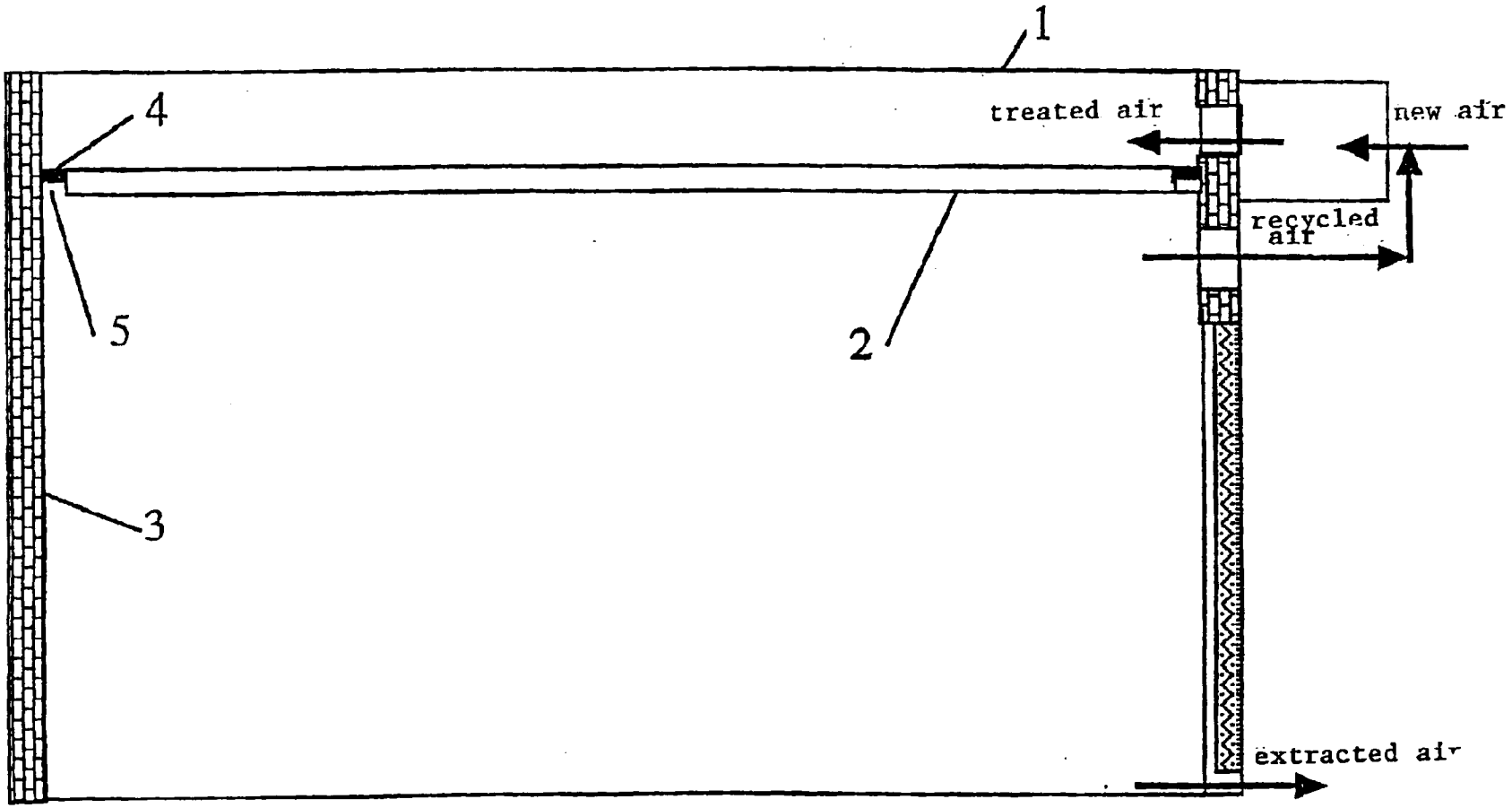
FIG. 2 shows a sectional drawing AA in a vertical plane of an air-conditioned building according to the invention.
Figure 3:
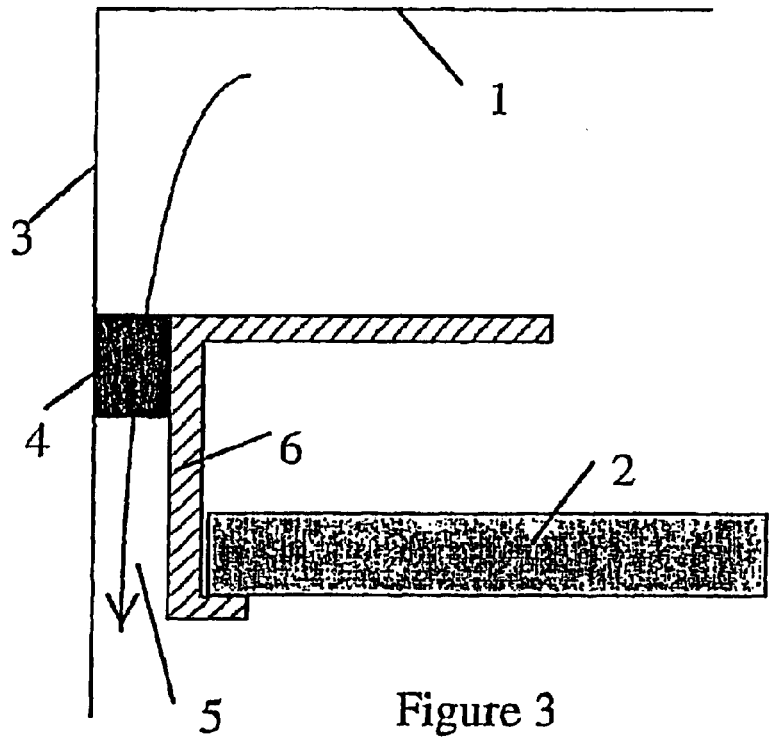
FIG. 3 shows a sectional drawing in a vertical plane perpendicular to the wall of the detail of the connection of the edge rail with the wall in the case where the false ceiling consists of a rigid material.
Figure 4:
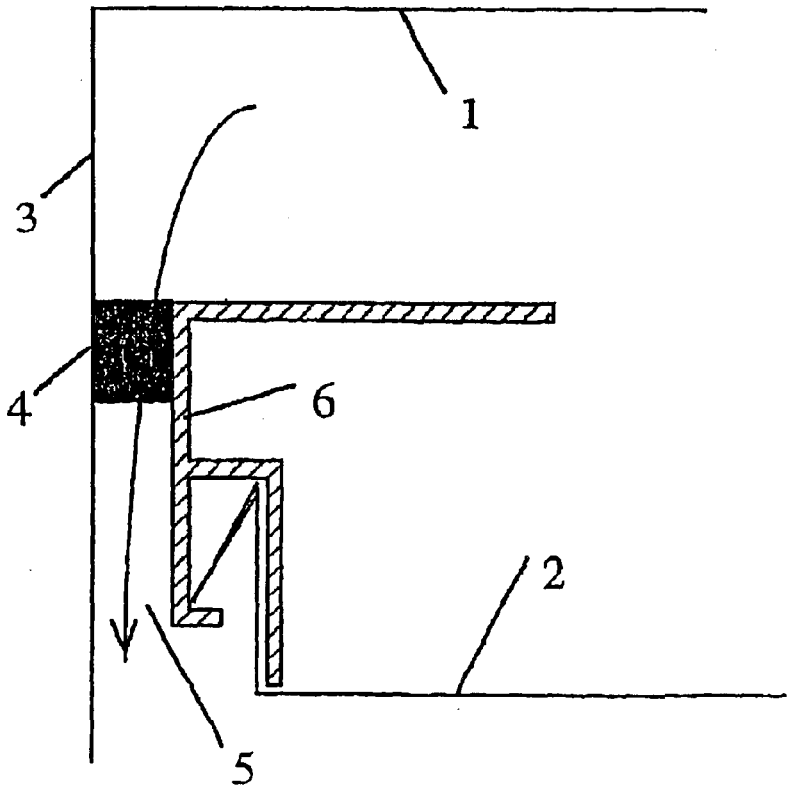
FIG. 4 shows a sectional drawing in a vertical plane that is perpendicular to the wall of the detail of the connection of the edge rail to the wall in the case where the false ceiling consists of a stretched elastic membrane, whereby the shape of the edge rail of the stretched membrane is given by way of indication.
Figure 5:
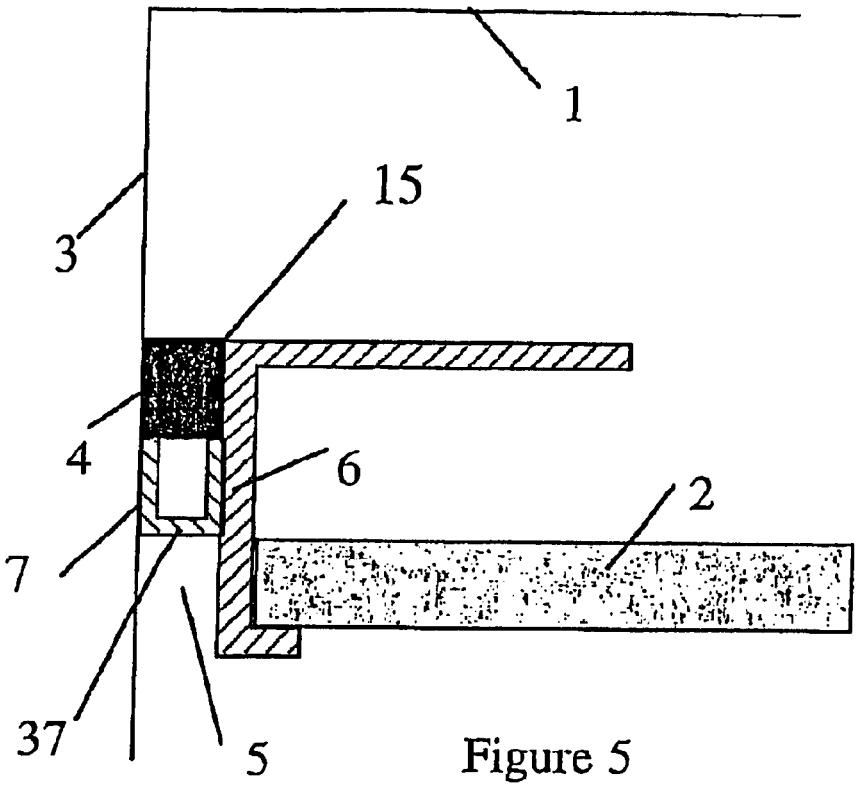
FIG. 5 shows a sectional drawing in a vertical plane that is perpendicular to the wall of a device that improves the invention.

In reference to these drawings, the device according to the invention comprises crosspieces 4 between wall 3 and false ceiling 2 of a small width parallel to the wall and evenly spaced. These crosspieces thus reserve a space 5 between wall 3 and rail 6. This space makes possible diffusion over the entire periphery of the building of treated air that is moderated after its passage into the false ceiling volume that is created by the space between ceiling 1, sealed false ceiling 2 and walls 3 because of the heat exchange of this air by convection with false ceiling 2 and ceiling 1. Said crosspieces 4 are bolted, for example, to walls 3 or to edge rail 6 or directly integral with rail 6 if the latter is made of a plastic material in a single injection-molding operation. These crosspieces have a thickness that is perpendicular to wall 3 that is calculated to obtain a diffusion rate of the treated air in the building with a fairly low rate of renewal.

According to the invention, the air-conditioning device is equipped, in predetermined zones, with one or more rods 7 that are gripped between rail 6 and wall 3 so as to close space 5 in the zones where it is desired to block the diffusion of air.

According to a first embodiment of the invention, rods 7 that are gripped between rail 6 and wall 3 can be full rods. It is also possible, according to another embodiment of the invention, to produce these rods 7 in the form of rods that are pierced with orifices such as holes or slots.

Figure 6:
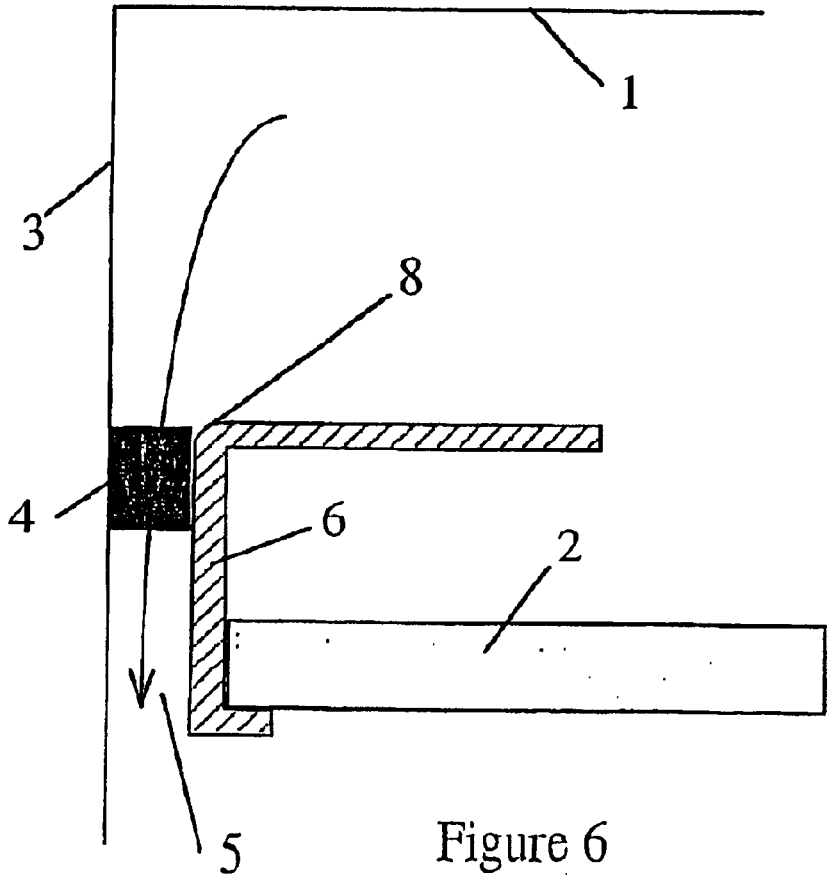
FIG. 6 shows a sectional drawing in a vertical plane that is perpendicular to the wall of a device that improves the invention.

In the embodiment according to FIG. 6, edge rail 6 of the false ceiling comprises at its upper part a rounded shape 8, on its upper ridge 15 on the side of the wall, whereby the center of the curvature of this rounded shape 8 is oriented toward the interior of the building. This rounded shape 8 has the advantage of facilitating the flow of air into space 5 by reducing pressure drops there.

Figure 7:
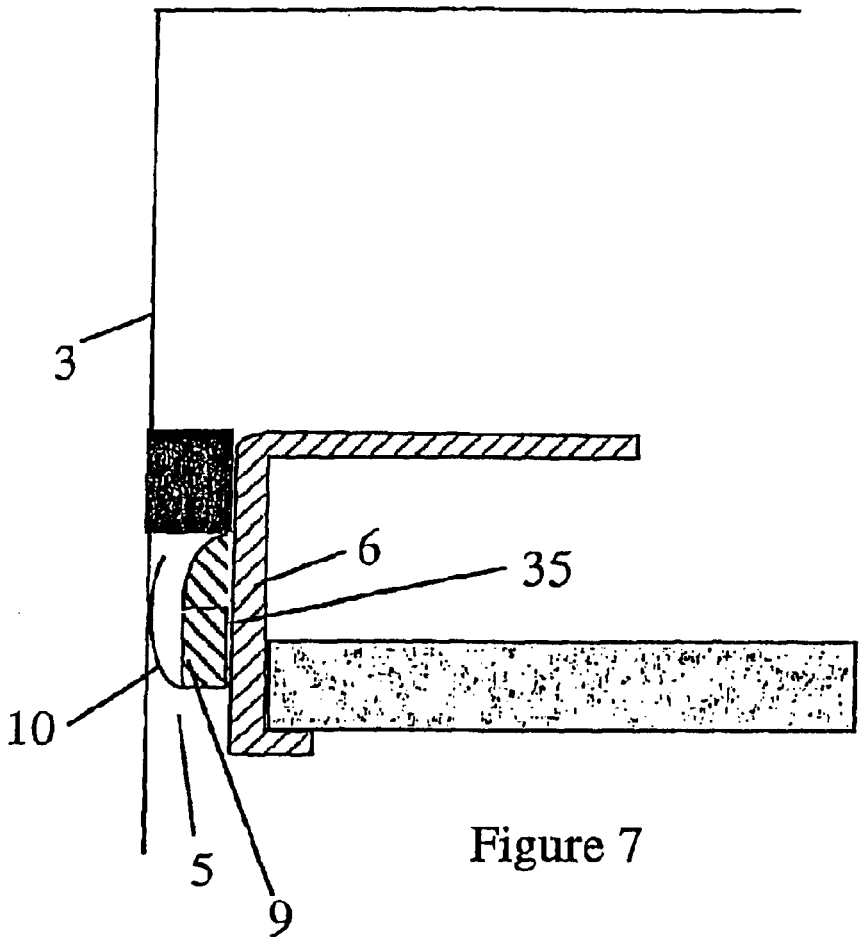
FIG. 7 shows a sectional drawing in a vertical plane that is perpendicular to the wall of a device that improves the invention.

In the embodiment according to FIG. 7, a rod 9, whose thickness perpendicular to wall 3 is less than the distance between wall 3 and face 35 that is beside the wall of the core of rail 6, is placed in space 5 against face 35 of rail 6 or against the wall. This rod can comprise on its wall-side face flexible blades 10 of a small width extending parallel to the wall and spaced evenly on the rod, so as to carry out, by a spring effect, its gripping in space 5 between rail 6 and wall 3. This rod 9, placed over the entire periphery or over a portion of the periphery of the building, makes it possible to reduce the passage section of the treated air in space 5 so as to increase its speed and therefore to force the air downward in the building when the device operates in heating mode.

Edge rail 6 can be provided with a means that makes possible a variable closing of space 5 that is reserved between the wall and edge rail 6.

Figure 8:
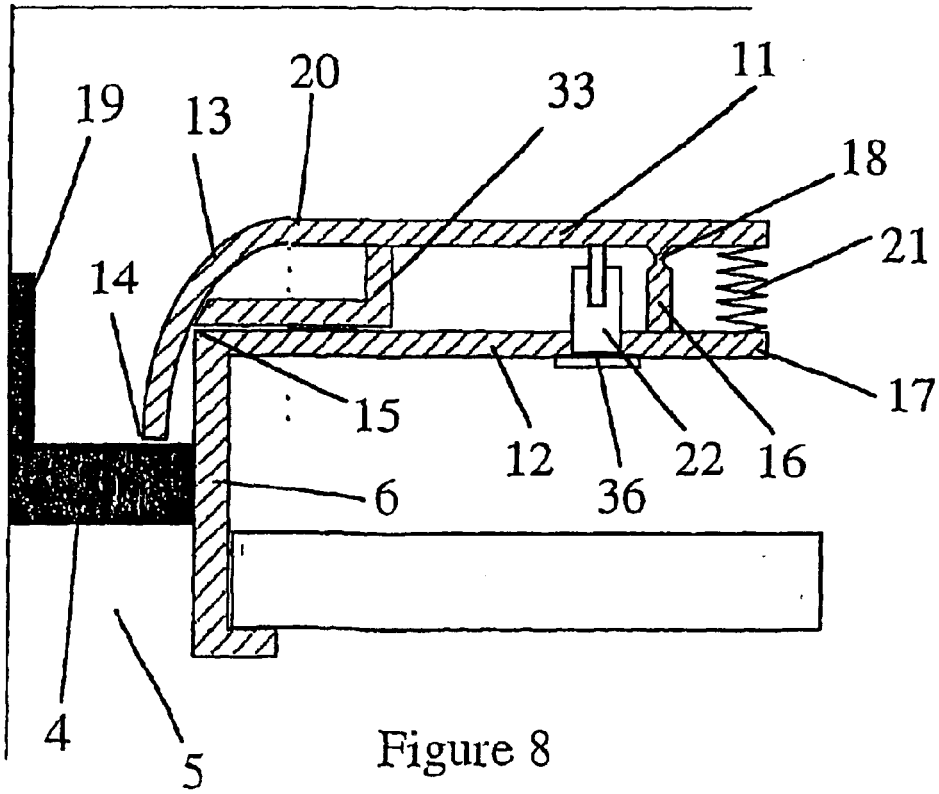
FIG. 8 shows a sectional drawing in a vertical plane that is perpendicular to the wall of a device that improves the invention.

FIG. 8 shows a means that allows a variable closing of the space reserved between the wall and the edge rail. Edge rail 6 comprises, on the one hand, a horizontal wing 12 that is integral with rail 6 on its upper part, and, on the other hand, a strip 20 that consists of a blade 11, parallel to upper wing 12 of edge rail 6 and above, extended from the wall side by a rounded shape 13, whose center of the curvature is oriented toward the interior of the building, whereby end 14 of the rounded shape on the side of the wall penetrates space 5 above crosspieces 4 by resting on upper ridge 15 on the side of the wall of rail 6. This closing strip 20 has an L shape 33 that produces a closed box between curved part 13 and blade 11 so as to make rigid said closing strip 20 in bending. Whereby said closing strip 20 is linked to upper wing 12 of rail 6 via a vertical blade 16 that is located closer to the end on building side 17 than ridge 15, a joint between said strip 20 and vertical blade 16 can be carried out by a zone of less thickness 18 or by any other means. This device comprises a means that makes it possible to actuate the rotation of strip 20 around joint 18. Blocks 19 are placed flush with wall 3 and extend crosspieces 4 in their upper part; they have less thickness perpendicular to the wall than crosspieces 4 but with a width parallel to the wall that is approximately identical or equal to that of crosspieces 4. Coil springs or leaf springs 21 that have the function of retractile springs are placed at regular intervals between blade 11 of strip 20 and wing 12 of rail 6 beside its end 17, keeping strip 20 abutting against stop 15 of rail 6.

A means that makes it possible to actuate the rotation of strip 20 around joint 18 can consist of electromagnets 22, evenly spaced, mounted, thanks to a recess 36 made in rail 6, between blade 11 of strip 20 and wing 12 of rail 6, close to vertical blade 16 of the wall side. Said electromagnets are controlled at a distance, either by a circuit breaker or by slaving at a predetermined temperature in a certain location and at a certain level in a building. The action of said electromagnets causes the lifting of strip 20 when the building needs to be heated instead of being cooled. The lifting to the level of the electromagnet is scaled down by a lever effect due to the rotation of strip 20 around joint 18. This rotation of strip 20 causes a partial and automatic closing of space 5 so as to reduce the speed of the diffused air. A block 19 can be used as a stop to limit the closing of this space so that the air always circulates there.

Figure 9:
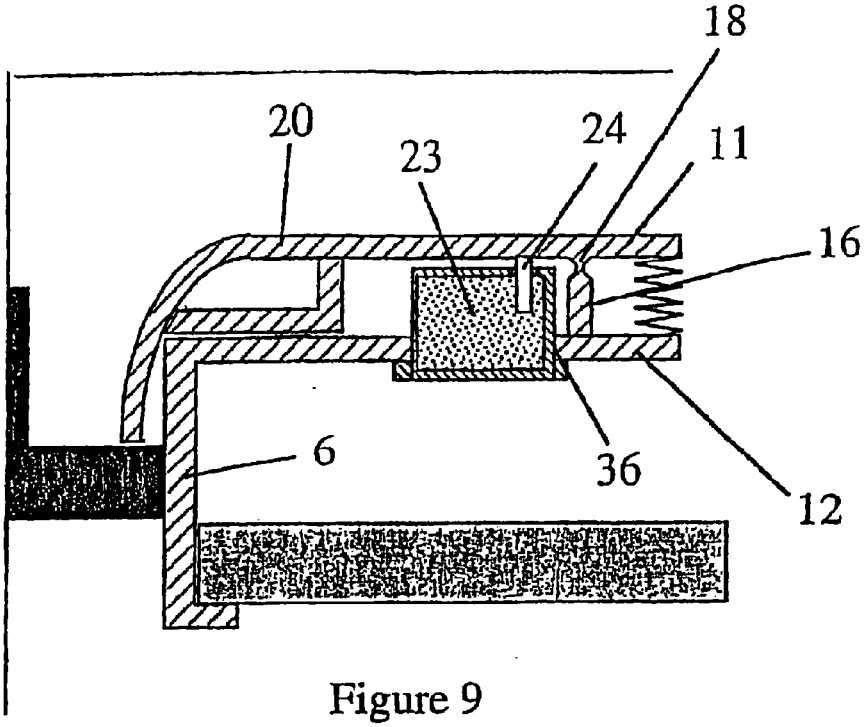
FIG. 9 shows a sectional drawing in a vertical plane that is perpendicular to the wall of a device that improves the invention.

FIG. 9 represents a means that makes it possible to actuate the rotation of strip 20 around joint 18. This means comprises reservoirs 23 that contain wax, liquid or saturating vapor, so-called bulbs for expansion of wax or liquid or a saturating vapor, that can advantageously replace the electromagnets that are mentioned above. Said bulbs comprise, in effect, in their upper portion, a piston 24 or an elastic membrane or a bellows that actuates the rotation of strip 20 in case of an increase in temperature that causes the expansion of wax or liquid or the evaporation of a fluid that is located in said bulbs.

Figure 10:
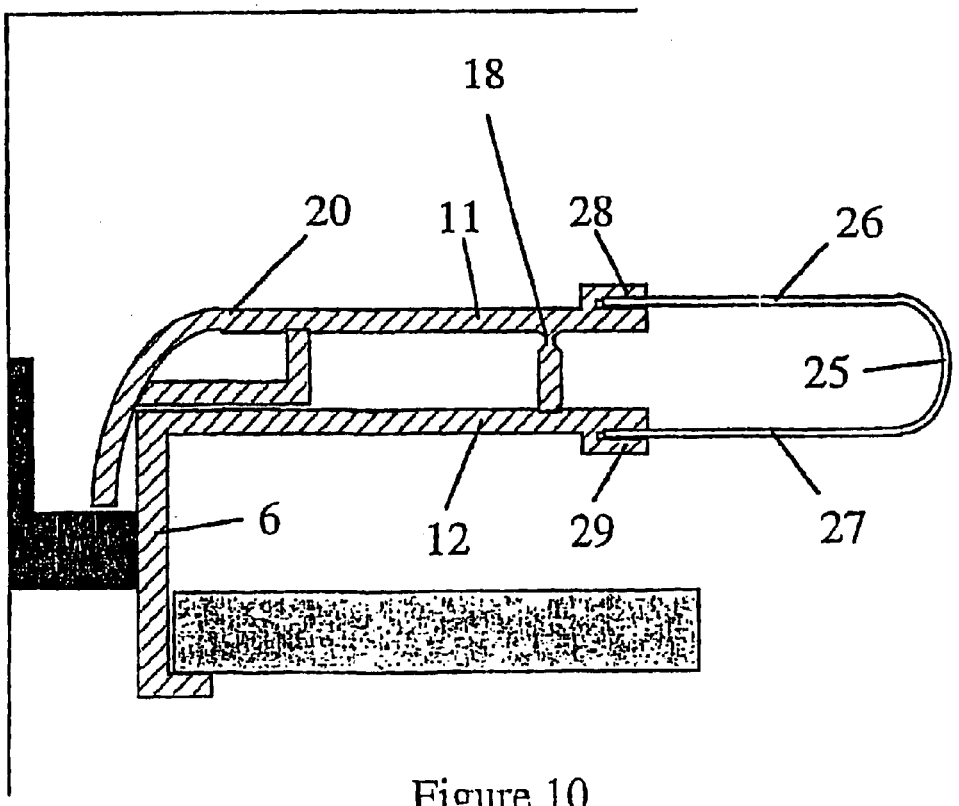
FIG. 10 shows a sectional drawing in a vertical plane that is perpendicular to the wall of a device that improves the invention.

FIG. 10 shows a means that makes it possible to actuate the rotation of strip 20 around joint 18. This means comprises U-shaped bimetallic strips 25 that comprise two long wings 26 and 27, consisting of two materials with very different expansion coefficients that are integral with one another over their entire surface, gripped at regular intervals in slots 28 and 29 that are provided for this purpose in blade 11 of strip 20 and in wing 12 of rail 6. Said bimetallic strips are produced such that of the two materials of which they are constituted, the one that has the highest expansion coefficient under the effect of an increase in temperature is located on the outside face of U 25. The differential expansion of the two materials that constitute the bimetallic strip causes the two ends of wings 28 and 29 to move toward one another, in the case of an increase in the temperature of the air above the false ceiling. This drawing-together causes a rotation of closing strip 20 around joint 18 and thus a partial closing of space 5.

Figure 11:
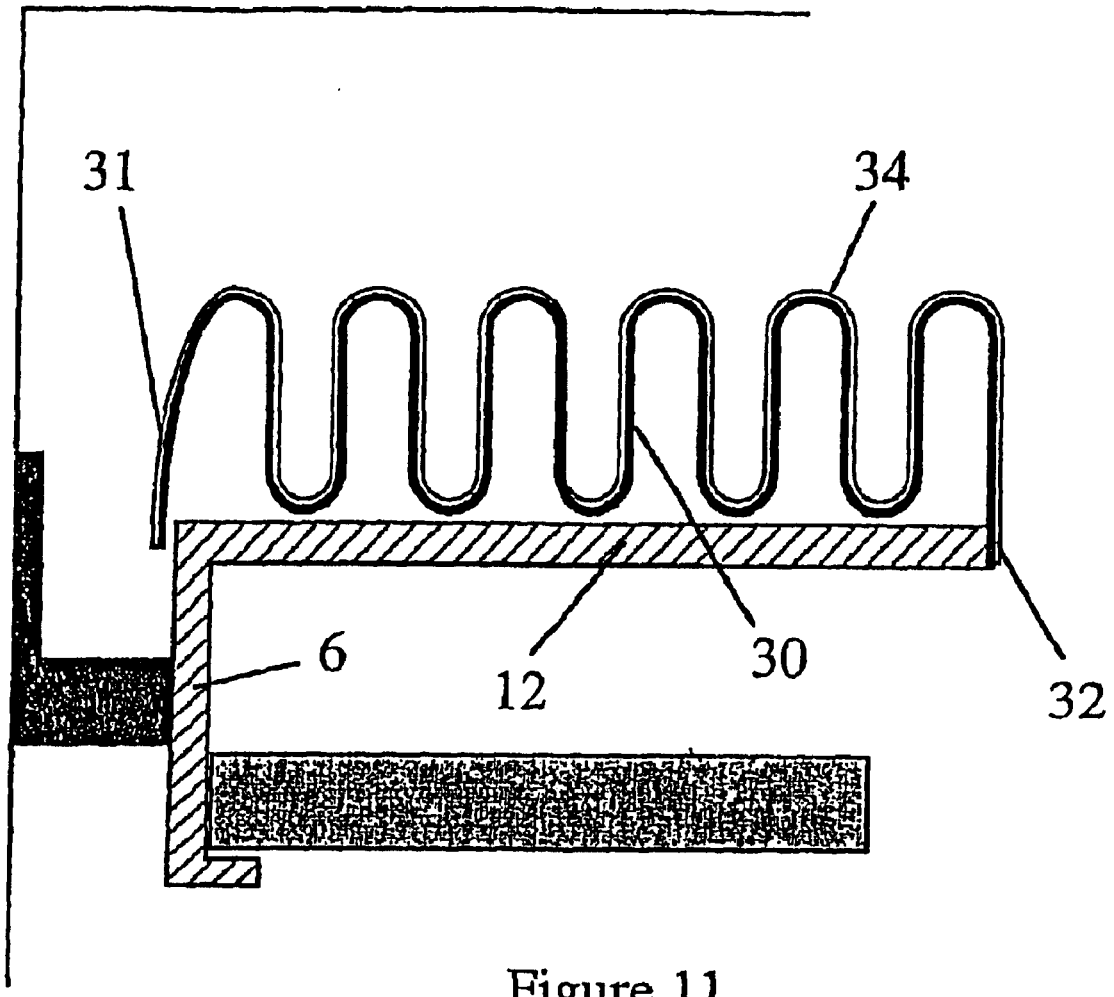
FIG. 11 shows a sectional drawing in a vertical plane that is perpendicular to the wall of a device that improves the invention.

In the embodiment according to FIG. 11, the means that makes possible a variable closing of space 5 comprises an undulating shape 30 that ends on the side of the wall by a rounded shape 31, whose end penetrates space 5 and is attached by its other end to end 32 of horizontal wing 12, whereby said section 30 is, on its upper face, covered and integral with a sheet 34 that consists of a material that has a lower thermal expansion coefficient than the one of the material that constitutes section 30. Thus, under the effect of an increase in temperature in the volume above the false ceiling, the differential expansion of the two materials that constitute section 30 and sheet 34 causes rounded shape 31 to move toward the wall and therefore causes a partial closing of opening 5, a closing that is limited by the blocks that are located above the crosspieces.

Relative to a traditional air-conditioning by blowing treated air in the upper part of the building, the device according to the invention requires, if the last embodiment described above is used, the placement of a single section, the placement of rods 7 at carefully selected locations and then the placement of the false ceiling.

By way of nonlimiting example, the device according to the invention is particularly intended for the comfortable air-conditioning of buildings such as:

Apartments and houses,

Commercial buildings such as banks, stores, pharmacies,

Medical and dental offices,

Exhibition halls, with the exception of halls of great height,

Offices and computer rooms,

Hotel and hospital rooms,

Schools and universities.

Of course, the invention is not limited to the embodiment described and shown in the accompanying drawings. Modifications are possible, in particular from the viewpoint of the constitution of various elements or by substitution of equivalent techniques, without thereby exceeding the field of protection of the invention.

What is claimed is:

1. Comfortable room with an air-conditioning device, comprising:

an air means introducing treated air into a volume defined by a false ceiling (2), a high ceiling (1) located above the false ceiling, and walls (3) located between the false ceiling and the high ceiling;

crosspieces (4) located between said walls (3) and adjacent edge rails (6) of said false ceiling (2), said crosspieces parallel to said walls and spaced around said false ceiling, said crosspieces (4) being attached to one of said walls (3) and said edge rails (6); and a diffusion space (5) located adjacent said crosspieces (4), and between the wall (3) and the rail (6), the diffusion space (5) for diffusing air through said space over a periphery of the room.

2. Comfortable room according to claim 1, further comprising:

in predetermined zones, at least one rod (7) gripped between the edge rail (6) and the wall (3), the rod controlling an extent of closing of the diffusion space between the rail (6) and the wall (3).

3. Building with an air-conditioning device, comprising:

an air means i) introducing treated air in a volume above a sealed false ceiling (2) and ii) ensuring a diffusion of air along walls (3) by allowing treated air to enter into the volume created by a space between an upper ceiling (1), the sealed false ceiling (2) and walls (3), the air means comprising crosspieces located between the wall (3) and an edge rail (6) of the false ceiling (2), the crosspieces being of a small width, parallel to the wall and evenly spaced, the crosspieces (4) attached to one of the walls (3) and the edge rail (6), the crosspieces reserving a diffusion space between the wall (3) and the false ceiling (2) so as to allow the diffusion of air over the entire periphery of the building, and in predetermined zones, at least one rod (7) gripped between the rail (6) and the wall (3), the rod closing the diffusion space in the zones to block the diffusion of the air, wherein, the edge rail (6) of the false ceiling comprises, in an upper portion, a rounded shape (8), and on an upper wall-side ridge (15), the center of the curvature of the rounded shape is oriented toward an interior of the building.

4. Building with an air-conditioning device, comprising:

a means introducing treated air in a volume above a seal false ceiling (2) and ensuring a diffusion of air along walls by allowing treated air to enter into the volume created by a space between an upper ceiling (1), the sealed false ceiling (2) and walls (3), the means comprising crosspieces between the wall (3) and an edge rail (6) of the false ceiling (2), the crosspieces being of a small width parallel to the wall and evenly spaced, wherein said crosspieces (4), attached to one of the walls (3) and the edge rail (6), reserve a space between the wall (3) and the false ceiling (2) so as to allow the diffusion of air over the entire periphery of the building, and in predetermined zones, one or more rods (7) gripped between the rail (6) and the wall (3) and closing the space in the zones to selectively block the diffusion of the air, and a rod (9) having a thickness perpendicular to the wall (3) less than the distance between the wall (3) and a wall-side face (35) of a core of rail (6), is gripped in the space (5) between the rail (6) and the wall (3) over at least a portion of the periphery of the building.

5. Building with an air-conditioning device, comprising:

a means introducing treated air into a volume above a sealed false ceiling (2) that ensures a diffusion of air along walls by allowing treated air to enter into the volume created by the space between ceiling (1), the sealed false ceiling (2) and walls (3), the means comprising crosspieces between the wall (3) and the edge rail (6) of false ceiling (2), the crosspieces of a small width parallel to the wall and evenly spaced, wherein said crosspieces (4), attached to one of the walls (3) and the edge rail (6) of the false ceiling (2), reserve a space between the wall (3) and the false ceiling (2) to allow the diffusion of air over the entire periphery of the building, and in predetermined zones, one or more rods (7) gripped between the rail (6) and the wall (3) to close the space in the zones to block the diffusion of the air, and rail (6) is provided with closing means that allows a variable closing of the space (5), said closing means comprising a horizontal wing (12) that is integral with an upper part of the rail (6), and a strip (20) that comprises a blade (11), parallel to and above the upper wing (12), the blade extended beside the wall by a rounded shape (13) having a center of the curvature oriented toward the interior of the building, an end (14) of the rounded shape, on the side of the wall penetrates the space (5), being above one crosspiece (4) and resting on an upper ridge (15) of the rail (6), the end (14) including an L shape (33) that produces a closed box between the curved part (13) and the blade (11), wherein said strip (20) is linked to the upper wing (12) of the rail (6) by a vertical blade (16) that is located closer to a building-side end (17) than the upper ridge (15), wherein said closing means also comprises an actuator means that allows actuation of rotation of the strip (20) around a joint (18).

6. Room according to claim 2, wherein each rod is a full rod.

7. Building according to claim 3, wherein each rod is a full rod.

8. Building according to claim 4, wherein each rod is a full rod.

9. Building according to claim 5, wherein each rod is a full rod.

10. Room according to claim 2, wherein each rod is pierced with orifices.

11. Building according to claim 3, wherein each rod is pierced with orifices.

12. Building according to claim 4, wherein each rod is pierced with orifices.

13. Building according to claim 5, wherein each rod is pierced with orifices.

14. Room according to claim 2, wherein the edge rail (6) comprises, at an upper portion, a rounded shape (8), wherein on an upper wall-side ridge (15), the center of the curvature of the rounded shape is oriented toward the interior of the room.

15. Building according to claim 4, wherein the edge rail (6) comprises, at an upper portion, a rounded shape (8), wherein on an upper wall-side ridge (15), the center of the curvature of the rounded shape is oriented toward the interior of the room.

16. Room according to claim 2, wherein a rod (9) with a thickness perpendicular to wall (3) less than a distance between the wall (3) and a wall-side face (35) of a core of rail (6), is gripped in the space (5) between the rail (6) and the wall (3) over at least a portion of the periphery of the room.

17. Building according to claim 3, wherein a rod (9) with a thickness perpendicular to wall (3) less than a distance between the wall (3) and a wall-side face (35) of a core of rail (6), is gripped in the space (5) between the rail (6) and the wall (3) over at least a portion of the periphery of the room.

18. Building according to claim 5, wherein a rod (9) with a thickness perpendicular to wall (3) less than a distance between the wall (3) and a wall-side face (35) of a core of rail (6), is gripped in the space (5) between the rail (6) and the wall (3) over at least a portion of the periphery of the room.

19. Room according to claim 2, wherein the rail (6) comprises a closing means that enables a variable closing of the space (5).

20. Building according to claim 3, wherein the rail (6) comprises a closing means that enables a variable closing of the space (5).

21. Building according to claim 4, wherein the rail (6) comprises a closing means that enables a variable closing of the space (5).

22. Building according the claim 21, wherein the closing means comprises:

a horizontal wing (12) that is integral with an upper part of the rail (6), and a strip (20) that comprises a blade (11), parallel to and above the upper wing (12), the blade extended beside the wall by a rounded shape (13) having a center of the curvature oriented toward the interior of the building, an end (14) of the rounded shape, on the side of the wall penetrates the space (5), being above one crosspiece (4) and resting on an upper ridge (15) of the rail (6), the end (14) including an L shape (33) that produces a closed box between the curved part (13) and the blade (11), wherein said strip (20) is linked to the upper wing (12) of the rail (6) by a vertical blade (16) that is located closer to a building-side end (17) than the upper ridge (15), and wherein said closing means also comprises an actuator means that allows actuation of rotation of the strip (20) around a joint (18).

23. Building according to claim 5, further comprising springs (21) placed at regular intervals between the blade (11) of the strip (20) and the wing (12) of the rail (6) beside an end (17) of the wing, the springs keeping the strip (20) abutting against a stop (15) of the rail (6).

24. Building according to claim 21, further comprising springs (21) placed at regular intervals between the blade (11) of the strip (20) and the wing (12) of the rail (6) beside an end (17) of the wing, the springs keeping the strip (20) abutting against a stop (15) of the rail (6).

25. Building according to claim 5, wherein the actuator means comprises an electromagnet (22), evenly spaced and controlled at a distance, by one of a circuit breaker and slaving at a predetermined temperature in a certain location and at a certain level in a room.

26. Building according to claim 22, wherein the actuator means comprises an electromagnet (22), evenly spaced and controlled at a distance, by one of a circuit breaker and slaving at a predetermined temperature in a certain location and at a certain level in a room.

27. Building according to claim 5, wherein the actuator means comprises reservoirs (23) containing wax, liquid or saturating vapor, expansion bulbs of wax or liquid or saturating vapor, evenly spaced, wherein in their upper part, said bulbs comprise a piston (24) or an elastic membrane or a bellows that actuates the rotation of the strip (20) around the joint (18) in case of increase in temperature, causing the expansion of the wax or of the liquid or the evaporation of a fluid that is located in said bulbs.

28. Building according to claim 22, wherein the actuator means comprises reservoirs (23) containing wax, liquid or saturating vapor, expansion bulbs of wax or liquid or saturating vapor, evenly spaced, wherein in their upper part, said bulbs comprise a piston (24) or an elastic membrane or a bellows that actuates the rotation of the strip (20) around the joint (18) in case of increase in temperature, causing the expansion of the wax or of the liquid or the evaporation of a fluid that is located in said bulbs.

29. Building according to claim 5, wherein the actuator means comprises U-shaped bimetallic strip (25) that comprise two long wings (26, 27) of two materials with different expansion coefficients, wherein said bimetallic strips are gripped at regular intervals in slots (28, 29) provided in the blade (11) of the strip (20) and in the wing (12) of the rail (6).

30. Building according to claim 22, wherein the actuator means comprises U-shaped bimetallic strip (25) that comprise two long wings (26, 27) of two materials with different expansion coefficients, wherein said bimetallic strips are gripped at regular intervals in slots (28, 29) provided in the blade (11) of the strip (20) and in the wing (12) of the rail (6).

31. Building according to claim 21, wherein the closing means comprises a corrugated section (30) that ends on the side of the wall by a rounded shape (31), whose end penetrates space (5) and is attached by another end to the end (32) of the horizontal wing (12), wherein said section (30) is, on an upper face, covered and integral with a sheet (34) of a material that has a lower thermal expansion coefficient than the material constituting the corrugated section (30).

* * * * *